US005853543A

United States Patent [19]

Hu et al.

[11] Patent Number: 5,853,543

[45] Date of Patent: Dec. 29, 1998

[54] METHOD FOR MONITORING AND CONTROLLING WATER CONTENT IN PAPER STOCK IN A PAPER MAKING MACHINE

[75] Inventors: Hung-Tzaw Hu, Saratoga; Francis Tu, Cupertino, both of Calif.

[73] Assignee: Honeywell-Measurex Corporation, Cupertino, Calif.

[21] Appl. No.: 789,086

[22] Filed: Jan. 27, 1997

[51] Int. Cl.[6] ..... D21F 11/00; G01N 33/34

[52] U.S. Cl. ..... 162/198; 162/DIG. 6; 162/DIG. 10; 162/DIG. 11; 364/471.01; 364/471.03; 364/568

[58] Field of Search ..... 162/198, 252, 162/258, 259, 262, 263, DIG. 6, DIG. 10, DIG. 11, 61; 364/471.01, 471.02, 471.03, 568

[56] References Cited

U.S. PATENT DOCUMENTS

| | | | |
|---|---|---|---|
| 3,260,642 | 7/1966 | Canter | 162/252 |
| 3,593,128 | 7/1971 | Perry . | |
| 3,630,836 | 12/1971 | Bietry et al. | 162/198 |
| 3,636,327 | 1/1972 | Troutman | 235/151.33 |
| 3,654,075 | 4/1972 | Keyes et al. | 162/254 |
| 3,723,865 | 3/1973 | Batey et al. . | |
| 3,795,984 | 3/1974 | Meyer . | |
| 3,811,087 | 5/1974 | Schmelzer . | |
| 3,864,626 | 2/1975 | MacLean et al. . | |
| 3,986,110 | 10/1976 | Overall et al. . | |
| 4,135,151 | 1/1979 | Rogers et al. . | |
| 4,259,632 | 3/1981 | Ahtiainen . | |
| 4,314,878 | 2/1982 | Lee | 162/198 |
| 4,329,201 | 5/1982 | Bolton | 162/199 |
| 4,369,080 | 1/1983 | Johnson . | |
| 4,398,996 | 8/1983 | Bolton et al. | 162/198 |
| 4,468,611 | 8/1984 | Tward . | |
| 4,474,643 | 10/1984 | Lindblad | 162/198 |
| 4,514,812 | 4/1985 | Miller et al. . | |
| 4,580,233 | 4/1986 | Parker et al. . | |
| 4,588,943 | 5/1986 | Hirth . | |
| 4,613,406 | 9/1986 | Gess | 162/49 |
| 4,680,089 | 7/1987 | Aral et al. . | |
| 4,692,616 | 9/1987 | Hegland et al. . | |
| 4,707,779 | 11/1987 | Hu . | |
| 4,786,529 | 11/1988 | Boissevain . | |
| 4,791,353 | 12/1988 | Typpo . | |
| 4,817,021 | 3/1989 | Sowerby et al. . | |
| 4,827,121 | 5/1989 | Vidrine, Jr. et al. . | |
| 4,840,706 | 6/1989 | Campbell | 162/198 |
| 4,845,421 | 7/1989 | Howarth et al. . | |
| 4,903,538 | 2/1990 | Balakrishnan et al. | 73/159 |
| 4,909,070 | 3/1990 | Smith . | |
| 4,921,574 | 5/1990 | Hu | 162/198 |
| 4,924,172 | 5/1990 | Holmgren . | |
| 4,947,684 | 8/1990 | Balakrishnan | 73/159 |
| 4,957,770 | 9/1990 | Howarth . | |
| 4,980,846 | 12/1990 | Chapman | 364/550 |
| 4,986,410 | 1/1991 | Shields . | |
| 4,990,261 | 2/1991 | Ho | 210/709 |
| 4,994,145 | 2/1991 | Seymour | 162/49 |

(List continued on next page.)

OTHER PUBLICATIONS

Smook, G.A., Handbook for Pulp & Paper Technologists, 2d. ed., (Angus Wilde Publications), 1992, pp. 228–229.

*Primary Examiner*—Peter Chin
*Assistant Examiner*—Steven B. Leavitt
*Attorney, Agent, or Firm*—Burns, Doane, Swecker & Mathis, L.L.P.

[57] ABSTRACT

A method of predicting the dry stock weight of paper that is produced by a papermaking machine based on simultaneousness measurements of (1) the water weight of the paper stock on the fabric or wire of the papermaking machine and of (2) the dry stock weight of the paper product is provided. The invention which provides a linearized model of the de-watering process is based in part on that creation of drainage characteristic curves that provides an effective means of predicting the drainage behavior of the paper stock on the fabric of a de-watering system.

22 Claims, 2 Drawing Sheets

U.S. PATENT DOCUMENTS 5,013,403 5/1991 Chase .
5,020,469 6/1991 Boissevain et al. .
5,021,740 6/1991 Sarr et al. .
5,022,966 6/1991 Hu ..... 162/198
5,045,798 9/1991 Hendrick .
5,052,223 10/1991 Regnault et al. .
5,067,345 11/1991 Mougne .
5,093,795 3/1992 Lewis ..... 364/471
5,122,754 6/1992 Gotaas .
5,124,552 6/1992 Anderson .
5,132,631 7/1992 Klopfenstein et al. .
5,134,380 7/1992 Jonas .
5,170,128 12/1992 Masurat et al. .
5,170,670 12/1992 Fasching et al. .
5,177,445 1/1993 Cross .
5,198,777 3/1993 Masuda et al. .
5,206,599 4/1993 Mayer .
5,208,544 5/1993 McBrearty et al. .
5,225,785 7/1993 Mayer et al. .
5,241,280 8/1993 Aidun et al. .
5,247,261 9/1993 Gershenfeld .
5,262,955 11/1993 Lewis ..... 364/471
5,270,664 12/1993 McMurtry et al. .
5,340,442 8/1994 Gess et al. ..... 162/198
5,400,247 3/1995 He ..... 364/148
5,492,601 2/1996 Ostermayer et al. ..... 162/198
5,539,634 7/1996 He ..... 364/158
5,561,599 10/1996 Lu .
5,563,809 10/1996 Williams et al. ..... 364/550
5,636,126 6/1997 Heaven et al. ..... 364/471.03
5,658,432 8/1997 Heaven et al. ..... 162/198

METHOD FOR MONITORING AND CONTROLLING WATER CONTENT IN PAPER STOCK IN A PAPER MAKING MACHINE

FIELD OF THE INVENTION

The invention is directed to an apparatus and method for measuring and monitoring the dry stock weight of a material. The invention has particular application in papermaking and related fields such as manufacture of board materials, newsprint, papers towels and tissues. It may also find application generally to materials that are water-absorbent and are produced in sheet or web form, such as textiles. It may also find still more general application to other water-absorbent materials such as those manufactured in granular form particularly where they are moved on a conveyor and thus have a resemblance to a moving web of wet paper. The invention will be discussed and its practice described with specific reference to papermaking.

BACKGROUND OF THE INVENTION

In the manufacture of paper on continuous papermaking machines, a web of paper is formed from an aqueous suspension of fibers (stock) on a traveling mesh papermaking fabric and water drains by gravity and vacuum suction through the fabric. The web is then transferred to the pressing section where more water is removed by dry felt and pressure. The web next enters the dryer section where steam heated dryers and hot air completes the drying process. The paper machine is, in essence, a de-watering, i.e., water removal, system. The majority of water then is taken out in the forming section as the stock is de-watered from a consistency to 0.1%–0.5% solids to a web having a consistency of about 10%–15% solids. A typical forming section of a papermaking machine includes an endless traveling papermaking fabric or wire which travels over a series of water removal elements such as table rolls, foils, vacuum foils, and suction boxes. The stock is carried on the top surface of the papermaking fabric and is de-watered as the stock travels over the successive de-watering elements to form a sheet of paper. Finally, the wet sheet is transferred to the press and dryer sections of the papermaking machine where enough water is removed to form a sheet of paper.

Papermaking devices well known in the art are described for example in "Pulp and Paper Manufacture", Vol. III (Papermaking and Paperboard Making), R. MacDonald, Ed., 1970, McGraw Hill, which is incorporated herein. Many factors influence the rate at which water is removed which ultimately affects the quality of the paper produced. As is apparent, it would be advantageous to monitor the dynamic process so as to, among other things, predict and control the dry stock weight of the paper that is produced.

SUMMARY OF THE INVENTION

The invention is directed to a method of predicting the dry stock weight of a sheet of material that is produced on a continuous de-watering system. As an example, with the present invention the dry stock weight of paper can be predicted by simultaneous measurements of (1) the water contents of the paper stock on the fabric or wire of the papermaking machine at three or more locations along the machine direction of the fabric and of (2) the dry stock weight of the paper product preceding the paper stock on the fabric. In this fashion, the expected dry stock weight of the paper that will be formed by the paper stock on the fabric can be determined at that instance. The invention is based in part on the creation of drainage characteristic curves that provide an effective means of predicting the drainage behavior of the paper stock on the fabric of a papermaking machine.

In one aspect, the invention is directed to a method of predicting the dry stock weight of a sheet of material that is moving on a water permeable fabric of a de-watering machine that includes the steps of:

a) placing three or more water weight sensors adjacent to the fabric wherein the sensors are positioned at different locations in the direction of movement of the fabric and placing a sensor to measure the dry weight of the sheet of material after being substantially de-watered;

b) operating the machine at predetermined operating parameters and measuring the water weights of the sheet of material at the three or more locations on the fabric with the water weight sensors and simultaneously measuring the dry weight of a part of the sheet of material that has been substantially de-watered;

c) performing bump tests to measure changes in water weight in response to perturbations in three or more operating parameters wherein each bump test is performed by alternately varying one of the operating parameters while keeping the others constant, and calculating the changes in the measurements of the three or more water weight sensors and wherein the number of bump tests correspond to the number of water weight sensors employed;

d) using said calculated changes in the measurements from step c) to obtain a linearized model describing changes in the three or more water weight sensors as a function of changes in the three or more operating parameters about said predetermined operating parameters wherein this function is expressed as an N×N matrix wherein N is equal to the number of water weight sensors employed; and e) developing a functional relationship between water weight measurements from the three or more water weight sensors for a segment of the moving sheet of material at the fabric and the predicted moisture level for the segment after being substantially de-watered.

The invention is particularly suited for use in a papermaking machine that comprises a forming section that includes the moving fabric and means for depositing an aqueous fiber stock comprising said material on a surface of the fabric, a plurality of de-watering mechanisms disposed sequentially underneath the fabric for removing water from said aqueous stock. Preferably, the bump tests comprise varying the flow rate of the aqueous fiber stock onto the fabric, freeness of the fiber stock, and concentration of fiber in the aqueous fiber stock. With the present invention, by continuously monitoring the water weight levels of the paper stock on the fabric, it is possible to predict the quality (i.e., dry stock weight) of the product. Furthermore, feedback controls can be implemented to change one or more operating parameters in response to fluctuations in predicted dry stock weight.

DESCRIPTION OF PREFERRED EMBODIMENTS

The water drainage profile on a fourdrinier wire is a complicated function principally dependent on the arrangement and performance of drainage elements, characteristics of the wire, tension on the wire, stock characteristics (for example freeness, pH and additives), stock thickness, stock temperature, stock consistency and wire speed. It has demonstrated that particularly useful drainage profiles can be generated by varying the following process parameters: 1) total water flow which depends on, among other things, the head box delivery system, head pressure and slice opening and slope position, 2) freeness which depends on, among other things, the stock characteristics and refiner power; and 3) dry stock flow and headbox consistency.

Water weight sensors placed at strategic locations along the paper making fabric can be used to profile the de-watering process (hereinafter referred to as "drainage profile"). By varying the above stated process parameters and measuring changes in the drainage profile, one can then construct a model which simulates the wet end paper process dynamics. Conversely one can use the model to determine how the process parameters should be varied to maintain or produce a specified change in the drainage profile. Furthermore with the present invention the dry stock weight of the web on the paper making fabric can be predicted from the water weight drainage profiles.

This invention combines knowledge of the effect of process parameters on drainage profile, and the prediction of dry stock weight from drainage profile, to construct a faster feedback system for controlling and maintaining the desired dry stock weight produced by the machine.

Papermaking Machine

Figure 1:
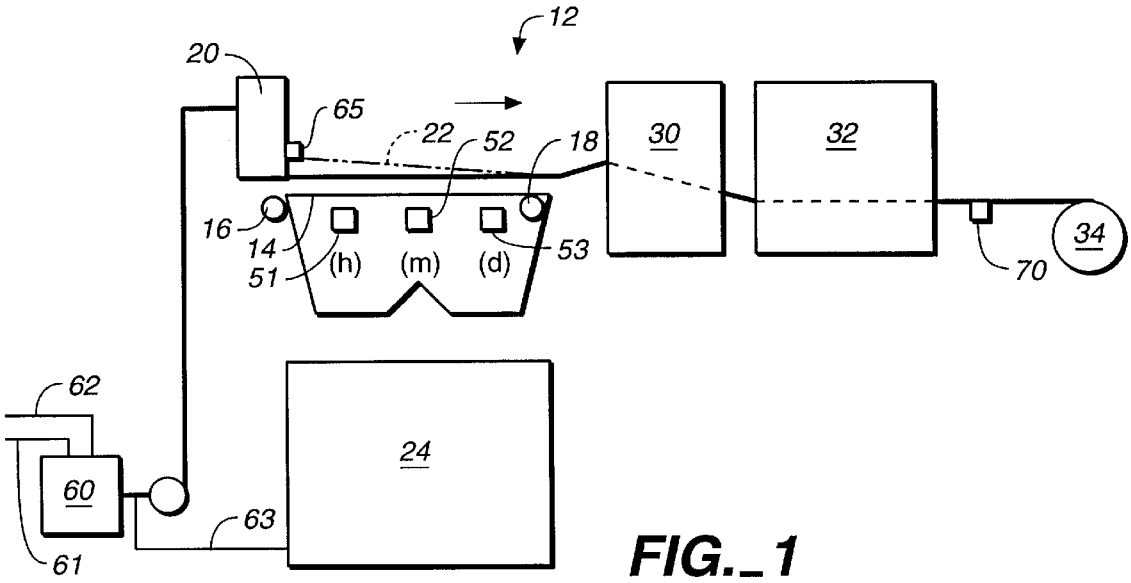
FIG. 1 is a sectional view of a papermaking machine illustrating the apparatus and method for monitoring de-watering and predicting the water content of the paper.

A papermaking machine is illustrated in FIG. 1. (The most common type of papermaking machine is the Fourdrinier machine.) Typically, forming section 12 includes a papermaking fabric 14. Usually, the fabric is formed from metal or plastic wires. The mesh allows drainage from the paper stock supported on the wire. The papermaking wire travels about a breast roll 16, couch roll 18, drive roll 20, and a plurality of directional rolls (not shown). A head box 20 receives a pulp fiber and water mixture from refiner 60 and deposits the water/fiber mixture through slice 65 onto the papermaking wire in a form commonly referred to as paper stock which is designated generally as 22.

The refiner 60 includes motorized disk elements to grind the paper fiber surfaces. Generally, the refiner is part of the stock preparation system which prepares, conditions, and/or treats the pulp or stock in such a manner that a satisfactory sheet of paper can be produced. The refiner is connected to a source of thick stock through line 61 and sources of water through line 62 and recirculation line 63. The thick stock is typically a higher consistency aqueous slurry of pulp which includes various additives such as, for example, dyes, pH adjusting agents, and adhesives. Aside from the compositional make-up of the paper stock, the operating parameters of the papermaking machine can also significantly affect the quality of the paper made. For instance, it is known that vigorously grinding the paper stock in the refiner reduces the rate at which water will drain through the wire mesh. Thus, it is common to refer to a rapidly draining stock as being "free", or having high freeness, whereas more highly grinded stock is referred to as being slow, or having low freeness. As a means of controlling the beating to give a uniform drainage rate, various blending techniques and well-defined test methods have been designed for the measurement of drainage-time, freeness, and slowness. The one most commonly used in North America is the Canadian Standard freeness tester which is used extensively in pulp quality control.

The slice 65 is typically a slot, or rectangular orifice, at the front of the headbox which allows the stock in the headbox to flow out on to the fabric. Its primary purpose is to take the relatively slow moving stock in the headbox at a high static head and discharge it into the atmosphere at a velocity close to the wire speed.

The paper forming section (also referred to as the "wet end") preferably has a plurality of de-watering devices disposed at sequential de-watering stations. For example, the de-watering devices may include a forming board, foil boxes, vacuum foil and/or suction boxes which are collecting designated as device 24. The paper stock is transferred from the forming section to the dry line which includes press section 30 and dryer section 32. The paper is then rolled into reel 34.

It is conventional to measure the dry weight of the moving material (i.e., paper) on leaving the main dryer section or at reel-up employing scanning sensor 70 and such measurement may be used to adjust the machine operation toward achieving desired parameters. One technique for measuring moisture content is to utilize the absorption spectrum of water in the infra-red region. Monitoring or gauge apparatus for this purpose is commonly in use. Such apparatus conventionally uses either a fixed gauge or a gauge mounted on a scanning head which is repetitively scanned transversely (i.e., cross-directionally) across the web at the exit from the dryer section and/or upon entry to reel-up, as required by the individual machines. The gauges typically use a broad-band infra-red source and one or more detectors with the wavelength of interest being selected by a narrow-band filter, for example, an interference type filter. The gauges used fall into two main types: the transmissive type in which the source and detector are on opposite sides of the web and, in a scanning gauge, are scanned in synchronism across it, and the scatter type (sometimes called "reflective" type) in which the source and detector are in a single head on one side of the web, the detector responding to the amount of source radiation scattered from the web. Scanning infra-red gauges of both the transmissive and scatter type are known. Suitable scatter type gauges are available as model number (s) 4201-13 and 4205-1 from Measurex Corporation, Cupertino, Calif. Preferably, the infra-red scanning gauge is movably supported on a beam extending normally to the web path to perform repetitive scanning across the web. A method of operating a scanning sensor is described in U.S. Pat. No. 4,921,574 which is incorporated herein by reference. Based on the moisture content measurements and determination of the basis weight, the dry weight of the paper at reel-up can be calculated.

In the forming section, gravity removes the water which falls through the open mesh of the papermaking fabric into water trays disposed below the forming section so that the water is recirculated to the refiner and/or headbox. Depending on the porosity of the fabric, some fibers (i.e., paper stock) may be lost in the forming section. Foil boxes remove water by hydrodynamic suction while also supporting the papermaking wire. The foils can be placed closer together or further apart to adjust the drainage per unit area of the papermaking fabric supported on the foils. Suction boxes remove water at progressively higher vacuum levels toward the couch roll. The couch roll is driven to drive both the papermaking fabric and the rest of the rolls. If a suction couch roll is used, there is a hollow shell with drilled holes and the roll is operated at relative higher vacuum. It will be understood that the foregoing de-watering mechanisms and forming sections are conventional. Accordingly, the aforementioned description contains only those features as is necessary to the understanding of the invention.

Three water weight sensors 51, 52, and 53 are illustrated to measure the water weight of the paper stock on the fabric. The position along the fabric at which the three sensors are located are designated "h", "m", and "d", respectively. More than three water weight sensors can be employed. It is not necessary that the sensors be aligned in tandem, the only requirement is that they are positioned at different machine directional positions. Typically, readings from the water weight sensor at location "h" which is closest to the head box will be more influenced by changes in stock freeness than in changes in the dry stock since changes in the latter is insignificant when compared to the large free water weight quantity. At the middle location "m", the water weight sensor is usually more influenced by changes in the amount of free water than by changes in the amount of dry stock. Most preferably location "m" is selected so as to be sensitive to both stock weight and free changes. Finally, location "d", which is closest to the drying section, is selected so that the water weight sensor is sensitive to changes in the dry stock because at this point of the de-water process the amount of water bonded to or associated with the fiber is proportional to the fiber weight. This water weight sensor is also sensitive to changes in the freeness of the fiber although to a lesser extent. Preferably, at position "d" sufficient amounts of water have been removed so that the paper stock has an effective consistency whereby essentially no further fiber loss through the fabric occurs.

The term "water weight" refers to the mass or weight of water per unit area of the wet paper stock which is on the web. Typically, the water weight sensors are calibrated to provide engineering units of grams per square meter (gsm). As an approximation, a reading of 10,000 gsm corresponds to paper stock having a thickness of 1 cm on the fabric. The particular water weight sensor employed is not critical and suitable sensors are commercially available from Measurex Corporation.

The term "dry weight" or "dry stock weight" refers to the weight of a material (excluding any weight due to water) per unit area.

The term "basis weight" refers to the total weight of the material per unit area.

The term "water weight sensor" refers to any device which can measure the water weight of moving sheet of material containing water (e.g., paper stock). A preferred water weight sensor is described in U.S. patent application Ser. No. 08/766,864 filed on Dec. 13, 1996 entitled "Electromagnetic Field Perturbation Sensor and Methods for Measuring Water Content in Sheetmaking Systems," to Chase et. al., of common assignee and bearing attorney docket number 018028-167. The sensor is sensitive to three properties of materials: the conductivity or resistance, the dielectric constant, and the proximity of the material to the sensor. Depending on the material (i.e., paper stock), one or more of these properties will dominate.

The basic embodiment of the sensor includes a fixed impedance element coupled in series with a variable impedance block between an input signal and ground. The fixed impedance element and the variable impedance block form a voltage divider network such that changes in impedance of the impedance block results in changes in voltage on the output of the sensor. The impedance block represents the impedance of the physical configuration of at least two electrodes within the sensor of the present invention and the material residing between and in close proximity to the electrodes. The impedance relates to the property of the material being measured.

The configuration of the electrodes and the material form an equivalent circuit which can be represented by a capacitor and resistor in parallel. The material capacitance depends on the geometry of the electrodes, the dielectric constant of the material, and its proximity to the sensor. For a highly conductive material, the resistance of the material is much less than the capacitive impedance, and the sensor measures the conductivity of the material.

In measuring paper stock, the conductivity of the mixture is high and dominates the measurement of the sensor. The proximity is held constant by contacting the support web in the papermaking system under the paper stock. The conductivity of the paper stock is directly proportional to the total water weight within the wetstock, consequently providing information which can be used to monitor and control the quality of the paper sheet produced by the papermaking system. In order to use this sensor to determine the weight of fiber in a paper stock mixture by measuring its conductivity, the paper stock is in a state such that all or most of the water is held by the fiber. In this state, the water weight of the paper stock relates directly to the fiber weight and the conductivity of the water weight can be measured and used to determine the weight of the fiber in the paper stock.

Formulation of Drainage Characteristics Curves

In this particular embodiment of the invention, three water weight sensors are used to measure the dependence of the drainage profile of water from the paper stock through the fabric on three machine operation parameters: (1) total water flow, (2) freeness of paper stock, and (3) dry stock flow or headbox consistency. Other applicable parameters include for example, (machine speed and vacuum level for removing water). For the case of three process parameters the minimum is three water weight sensors. More can be used for more detailed profiling.

A preferred form of modeling uses a baseline configuration of process parameters and resultant drainage profile, and then measures the effect on the drainage profile in response to a perturbation of an operation parameter of the fourdrinier machine. In essence this linearizes the system about the neighborhood of the baseline operating configuration. The perturbations or bumps are used to measure first derivatives of the dependence of the drainage profile on the process parameters.

Once a set of drainage characteristic curves has been developed, the curves, which are presented as a 3×3 matrix, can be employed to, among other things, predict the water content in paper that is made by monitoring the water weight along the wire by the water weight sensors. This information can be recorded, moreover, feedback controls can be implemented to control various process parameters in order to maintain the water weight of the paper at a desired level.

Bump Tests

The term "bump test" refers to a procedure whereby an operating parameter on the papermaking machine is altered and changes of certain dependent variables resulting therefrom are measures. Prior to initiating any bump test, the papermaking machine is first operated at predetermined baseline conditions. By "baseline conditions" is meant those operating conditions whereby the machine produces paper. Typically, the baseline conditions will correspond to standard or optimized parameters for papermaking. Given the expense involved in operating the machine, extreme conditions that may produce defective, non-useable paper is to be avoided. In a similar vein, when an operating parameter in the system is modified for the bump test, the change should not be so drastic as to damage the machine or produce defective paper. After the machine has reached steady state or stable operations, the water weights at each of the three sensors are measured and recorded. Sufficient number of measurements over a length of time are taken to provide representative data. This set of steady-state data will be compared with data following each test. Next, a bump test is conducted. The following data were generated on a Beloit Concept 3 papermaking machine, manufactured by Beloit Corporation, Beloit, Wis. The calculations were implemented with a microprocessor using LABVIEW 4.0.1 software from National Instrument (Austin Tex.).

Figure 2:
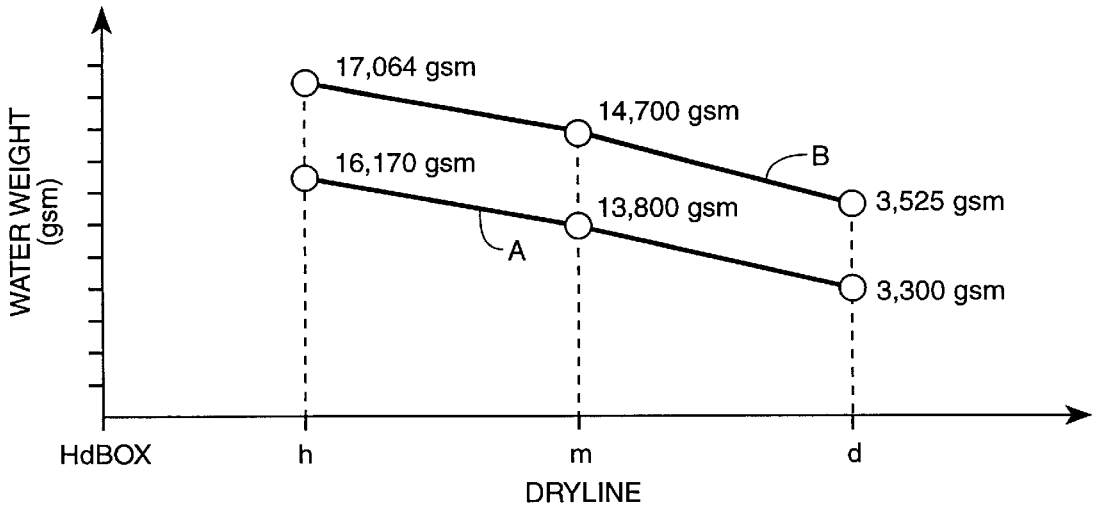
FIG. 2 is a graph of water weight versus wire position of a papermaking machine with different consistency in the stock.

(1) Dry stock flow test. The flowrate of dry stock delivered to the headbox is changed from the baseline level to alter the paper stock composition. Once steady state conditions are reached, the water weights are measured by the three sensors and recorded. Sufficient number of measurements over a length of time are taken to provide representative data. FIG. 2 is a graph of water weight vs. wire position measured during baseline operations and during a dry stock flow bump test wherein the dry stock was increased by 100 gal/min from a baseline flow rate of 1629 gal/min. Curve A connects the three water weight measurements during baseline operations and curve B connects the measurements during the bump test. As is apparent, increasing the dry stock flow rate causes the water weight to increase. The reason is that because the paper stock contains a high percentage of pulp, more water is retained by the paper stock. The percentage difference in the water weight at positions h, m, and d along the wire are +5.533%, +6.522%, and +6.818%, respectively.

For the dry stock flow test, the controls on the papermaking machine for the basic weight and moisture are switched off and all other operating parameters are held as steady as possible. Next, the stock flow rate is increased by 100 gal/min. for a sufficient amount of time, e.g., about 10 minutes. During this interval, measurements from the three sensors are recorded and the data derived therefrom are shown in FIG. 2.

Figure 3:
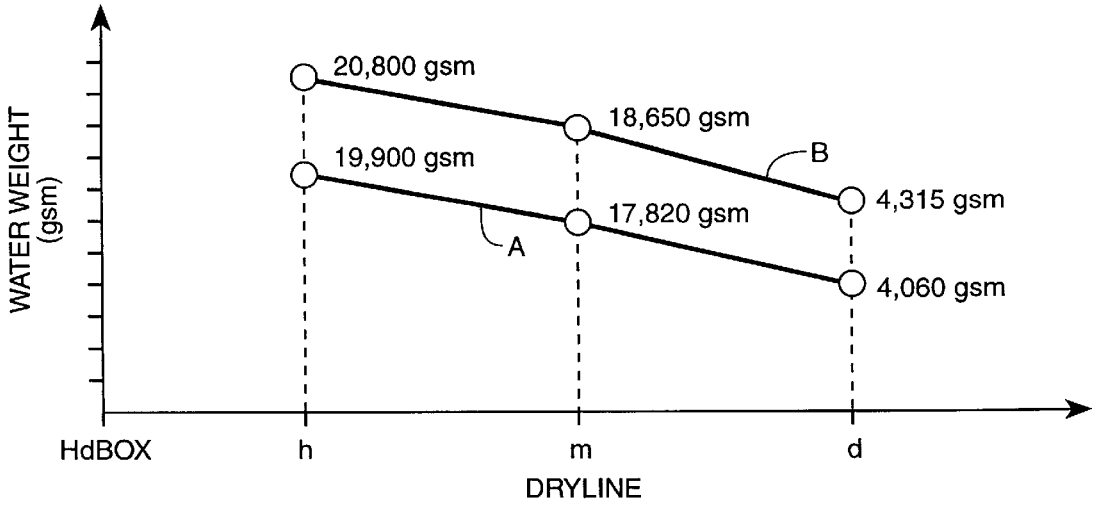
FIG. 3 is a graph of water weight versus wire position of a papermaking machine with different refiner power.

(2) Freeness test. As described previously, one method of changing the freeness of paper stock is to alter the power to the refiner which ultimately effects the level of grinding the pulp is subjected to. During the freeness test, once steady state conditions are reached, the water weights at each of the three sensors are measured and recorded. In one test, power to the refiner was increased from about 600 kw to about 650 kw. FIG. 3 is a graph of water weight vs. wire position measured during baseline operations (600 kw) (curve A) and during the steady state operations after an additional 50 kw are added (curve B). As expected, the freeness was reduced resulting in an increase in the water weight as in the dry stock flow test. Comparison of the data showed that the percentage difference in the water weight at positions h, m, and d are +4.523%, +4.658%, and +6.281%, respectively.

(3) Total paper stock flow rate (slice) test. One method of regulating the total paper stock flow rate from the head box is to adjust aperture of the slice. During this test, once steady state conditions are reached, the water weights at each of the three sensors are measured and recorded. In one test, the slice aperture was raised from about 1.60 in. (4.06 cm) to about 1.66 in. (4.2 cm) thereby increasing the flow rate. As expected, the higher flow rate increased the water weight. Comparison of the data showed that the percentage difference in the water weight at positions h, m, and d are +9.395%, +5.5%, and +3.333%, respectively. (The measurement at position m of 5.5% is an estimate since the sensor at this location was not in service when the test was performed.)

The Drainage Characteristic Curves (DCC)

From the previously described bump tests one can derive a set of drainage characteristic curves (DCC). The effect of changes in three process parameters on the three water weight sensor values provides nine partial derivatives which form a 3×3 DCC matrix. Generally, when employing n number of water weight sensors mounted on the wire and m bump tests, a n×m matrix is obtained.

Specifically, the 3×3 DCC matrix is given by:

$$DC_{Th}DC_{Tm}DC_{Td}$$

$$DC_{Fh}DC_{Fm}DC_{Fd}$$

$$DC_{Sh}DC_{Sm}DC_{Sd}$$

where T, F, S refer to results from bumps in the total water flow, freeness, and dry stock flow, respectively, and h, m, and d designate the positions of the sensors mounted along the fabric.

The matrix row components $[DC_{Th}DC_{Tm}DC_{Td}]$ are defined as the percentage of water weight change on total water weight at locations h, m, and d based on the total flow rate bump tests. More precisely, for example, "$DC_{Th}$" is defined as the difference in percentage water weight change at position h at a moment in time just before and just after the total flow rate bump test. $DC_{Tm}$ and DCTd designate the values for the sensors located at positions m and d, respectively. Similarly, the matrix row components $[DC_{Fh}DC_{Fm}DC_{Fd}]$ and $[DC_{Sh}DC_{Sm}DC_{Sd}]$ are derived from the freeness and dry stock bump tests, respectively.

Components $DC_{Th}$, $DC_{Fm}$ and $DC_{Sd}$ on the DDC matrix are referred to pivotal coefficients and by Gauss elimination, for example, they are used to identify the wet end process change as further described herein. If a pivot coefficient is too small, the uncertainty in the coefficients will be amplified during the Gauss elimination process. Therefore, preferably these three pivotal coefficients should be in the range of about 0.03 to 0.10 which corresponds to about 3% to 10% change in the water weight during each bump test.

Drainage Profile Change

Based on the DCC matrix, the drainage profile change can be represented as a linear combination of changes in the different process parameters. Specifically, using the DCC matrix, the percentage change in the drainage profile at each location may be computed as a linear combination of the individual changes in the process parameters: total water flow, freeness, and dry stock flow. Thus:

$$\Delta DP\%(h,t)=DCTh*w+DCFh*f+DCSh*s,$$

$$\Delta DP\%(m,t)=DCTm*w+DCFm*f+DCSm*s,$$

$$\Delta DP\%(d,t)=DCTd*w+DCFd*f+DCSd*s,$$

where (w, f, s) refer to changes in total water flow, freeness, and dry stock flow respectively, and the DC's are components of the DCC matrix.

By inverting this system of linear equations, one may solve for the values of (w, f, s) needed to produce a specified drainage profile change (ΔDP%(h), ΔDP%(m), ΔDP%(d). Letting A represent the inverse of the DCC matrix, $$\begin{bmatrix} A_{11} & A_{12} & A_{13} \\ A_{21} & A_{22} & A_{23} \\ A_{31} & A_{32} & A_{33} \end{bmatrix} \begin{bmatrix} \Delta DP\ \%\ (h) \\ \Delta DP\ \%\ (m) \\ \Delta DP\ \%\ (d) \end{bmatrix} = \begin{bmatrix} w \\ f \\ s \end{bmatrix} \text{ or}$$

$$w = A_{11}*\Delta DP\ \%\ (h) + A_{12}*\Delta DP\ \%\ (m) + A_{13}*\Delta DP\ \%\ (d)$$

$$f = A_{21}*\Delta DP\ \%\ (h) + A_{22}*\Delta DP\ \%\ (m) + A_{23}*\Delta DP\ \%\ (d)$$

$$s = A_{31}*\Delta DP\ \%\ (h) + A_{32}*\Delta DP\ \%\ (m) + A_{33}*\Delta DP\ \%\ (d)$$

The above equation shows explicitly how inverting the DCC matrix allows one to compute the (w, f, s) needed to effect a desired change in drainage profile, (ΔDP%(h), ΔDP%(m), ΔDP%(d)).

Empirically, the choice of the three operating parameters, the location of the sensors, and the size of the bumps produces a matrix with well behaved pivot coefficients, and the matrix can thus be inverted without undue noise.

By continuously comparing the dry weight measurement from scanner 70 in FIG. 1 with the water weight profiles measured at sensors h, m, and d, one can make a dynamic estimate of the final dry stock weight will be for the paper stock that is at the position of scanner 70.

Dry Stock Prediction

At location d which is closest to the drying section, the state of the paper stock is such that essentially all of the water is held by the fiber. In this state, the amount of water bonded to or associated with the fiber is proportional to the fiber weight. Thus the sensor at location d is sensitive to changes in the dry stock and is particularly useful for predicting the weight of the final paper stock. Based on this proportionality relation: DW(d)=U(d)*C(d), where DW(d) is the predicted dry stock weight at location d, U(d) is the measured water weight at location d and C(d) is a variable of proportionality relating DW to U and may be referred to as the consistency. Further, C(d) is calculated from historical data of the water weight and dry weight measured by the scanning sensor at reel-up.

Subsequent to position d in the papermaking machine (see FIG. 1), the sheet of stock exits forming section 24 and into press section 30 and dryer section 32. At location 70, a scanning sensor measures the final dry stock weight of the paper product. Since there is essentially no fiber loss subsequent to location d, it may be assumed that DW(d) is equal to the final dry stock weight and thus one can calculate the consistency C(d) dynamically.

Having obtained these relations, one can then predict the effect of changes in the process parameters on the final dry stock weight. As derived previously the DCC matrix predicts the effect of process changes on the drainage profile. Specifically in terms of changes in total water flow w, freeness f, and dry stock flow s, the change in U(d) is given by:

$$\Delta U(d)/U(d)=DC_{Td}*w+DC_{Fd}*f+DC_{Sd}*s$$

$$\Delta DW(d)=U(d)*[\alpha_T DC_{Td}*w+\alpha DC_{Fd}*f+\alpha DC_{sd}*s]*Ref(cd)$$

where Ref(cd) is a dynamically calculated value based on current dry weight sensor and historical water weight sensor readings and where the α's are defined to be gain coefficients which were obtained during the three bump tests previously described. Finally, the perturbed dry stock weight at location d is then given by:

$$DW(d)=U(d)*\{1+[\alpha_T DC_{tTd}*w+\alpha_F DC_{Fd}*f+\alpha_s DC_{Sd}*s]\}*Ref(cd)$$

The last equation thus describes the effect on dry stock weight due to a specified change in process parameters. Conversely, using the inverse of the DCC matrix one can also deduce how to change the process parameters to produce a desired change in dry weight (s), freeness (f) and total water flow (w) for product optimizations.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of predicting the dry stock weight of a sheet of material that is on a moving water permeable fabric of a de-watering machine that includes a dryer section located downstream from the water permeable fabric said method comprising the steps of:

a) placing three or more water weight sensors adjacent to the fabric wherein the sensors are positioned at different locations in the direction of movement of the fabric and placing a sensor to measure the dry weight of the sheet material after exiting the dryer section;

b) operating the machine at predetermined operating parameters aid measuring the water weights of the sheet of material at the three or more locations on the fabrics with the water weight sensors and simultaneously measuring the dry weight of a part of the sheet of material exiting the dryer section;

c) performing bump tests to measure changes in water weight in response to perturbations in three or more operating parameters wherein each bump test is performed by alternately varying one of the operating parameters while keeping the others constant, and calculating the changes in the measurements of the three or more water weight sensors and wherein the number of bump tests correspond to the number of water weight sensors employed;

d) using said calculated changes in the measurements from stop c to obtain a N×M matrix that expresses changes in the three or more water weight sensors as a function of changes in the three or more operating parameters about the predetermined operating parameters wherein N is equal to the number of water weight sensors employed and M is equal to the number of bump tests performed and N is equal to or greater than M; and e) developing an inverted N×M matrix that provides the predicted dry weight for a segment after being dried in the dryer section based on measurements from the three or more water weight sensors for said segment of the sheet of material on the moving fabric.

2. The method of claim 1 further comprising the step of measuring the water weight of the moving sheet with the three or more water weight sensors and simultaneously measuring the dry weight of a part of the sheet of material that has been dried in the dryer section and calculating the dry stock weight that the sheet of material that is on the fabric will be after being dried in the dryer section.

3. The method of claim 2 wherein each of the three or more water weight sensors is positioned underneath the water permeable fabric.

4. The method of claim 1 wherein the de-watering machine is a papermaking machine that comprises a forming section that includes the moving fabric and means for depositing an aqueous fiber stock comprising said material on a surface of the fabric, a plurality of de-watering mechanisms disposed sequentially underneath the fabric for removing water from said aqueous stock, wherein the step of performing the bump tests comprise varying the flow rate of the aqueous fiber stock onto the fabric, freeness of the fiber stock, or concentration of fiber in the aqueous fiber stock.

5. The method of claim 4 further comprising the step of changing one or more operating conditions of the papermaking machine in response to fluctuations in the calculated dry stock weight.

6. The method of claim 1 wherein the three or more water weight sensors that are positioned substantially in tandem.

7. The method of claim 1 wherein the step of placing three or more water weight sensors comprise (i) placing a water weight sensor adjacent to the fabric at a designated location on the fabric wherein substantially no solid stock material permeates through the fabric subsequent to the designated location and (ii) placing at least two water weight sensors on different locations on the fabric before said designated location as measured with respect to the direction of movement of the fabric.

8. The method of claim 1 wherein each of the three or more water weight sensors is positioned underneath the water permeable fabric.

9. The method of claim 1 wherein each of the three or more water weight sensors measures the water weight of the sheet of material.

10. The method of claim 1 wherein the sheet of material comprises paper stock.

11. The method of claim 1 wherein N is equal to M.

12. A method of controlling the dry stock weight of a sheet of material that is on a moving water permeable fabric of a de-watering machine that comprises the steps of:

a) placing three or more water weight sensors adjacent to the fabric wherein the sensors are positioned on different locations along the direction of movement of the fabric;

b) operating the machine at predetermined parameters and measuring the water weights of the sheet of material with the sensors;

c) performing bump tests to measure changes in water weights in response to perturbations in three or more operating parameters wherein each bump test is performed by alternately varying one of the operating parameters while keeping the others constant, and calculating the changes the measurements of three or more water weight sensors, wherein the number of bump tests corresponds to the number of sensors employed;

d) using said calculated changes in the measurements from step C to obtain an N×M matrix that expresses changes in the three or more water weight sensors in response to changes in the three or more operating parameters about the predetermined operating parameters wherein N is equal to the number of sensors employed and M is equal to the number of bump tests performed and N is equal to or greater than M;

e) inverting the matrix to derive a functional relationship which correlates changes in measurements from the three or more operating parameters to changes in the three water weight sensors; and f) employing said inverse function for controlling operation of the dewatering machine to produce a sheet of material having a desired dry stock weight.

13. The method of claim 12 wherein the de-watering machine is a papermaking machine that comprises a forming section that includes the moving fabric and means for depositing an aqueous fiber stock on a surface of said fabric, a plurality of de-watering mechanisms disposed sequentially underneath the fabric for removing water from said aqueous stock, wherein the step of performing the bump tests comprise varying the flow rate of the aqueous fiber stock onto the fabric, freeness of the fiber stock, or concentration of fiber in the aqueous fiber stock.

14. The method of claim 13 wherein each of the three or more water weight sensors is positioned underneath the water permeable fabric.

15. The method of claim 12 wherein the functional relationship calculates the change in one or more of the operating parameters needed to produce a specified change in water content of the sheet of material on the fabric.

16. The method of claim 12 wherein the de-watering device comprises a dryer section located downstream from the water permeable fabric and a second sensor to measure dry stock weight of the sheet of material after being dried in the dryer section.

17. The method of claim 12 wherein the three or more water weight sensors that are positioned substantially in tandem.

18. The method of claim 12 wherein the step of placing three or more water weight sensors comprise (i) placing a water weight sensor adjacent to the fabric at a designated location on the fabric wherein substantially no solid stock material permeates through the fabric subsequent to the designated location and (ii) placing at least two water weight sensors on different locations on the fabric before said designated location as measured with respect to the direction of movement of the fabric.

19. The method of claim 12 wherein each of the three or more water weight sensors is positioned underneath the water permeable fabric.

20. The method of claim 12 wherein each of the three or more water weight sensors measures the water weight of the sheet of material.

21. The method of claim 12 wherein the sheet of material comprises paper stock.

22. The method of claim 12 wherein N is equal to M.

* * * * *